US006105397A

United States Patent [19]

Stoll et al.

[11] Patent Number: 6,105,397

[45] Date of Patent: Aug. 22, 2000

[54] METHOD FOR PRODUCING A KNITTED ARTICLE ON A FLAT KNITTING MACHINE

[75] Inventors: Thomas Stoll, Reutlingen; Franz Schmid, Bodelshausen; Wolfgang Rempp, Gammertingen, all of Germany

[73] Assignee: H. Stoll GmbH & Co., Reutlingen, Germany

[21] Appl. No.: 09/205,553

[22] Filed: Dec. 4, 1998

[30] Foreign Application Priority Data

Dec. 17, 1997 [DE] Germany ..... 197 56 055

[51] Int. Cl.[7] ..... D04B 7/00

[52] U.S. Cl. ..... 66/62; 66/60 R; 66/64; 66/232

[58] Field of Search ..... 66/60 R, 64, 62, 66/69, 70, 71, 75.1, 75.2, 76, 77, 231, 232; 364/470.12

[56] References Cited

U.S. PATENT DOCUMENTS

| | | | |
|---|---|---|---|
| 4,167,861 | 9/1979 | Krause et al. | 66/232 |
| 4,821,534 | 4/1989 | Goller et al. | 66/60 R |
| 4,841,748 | 6/1989 | Watanabe et al. | 66/75.1 |
| 4,856,104 | 8/1989 | Sroll et al. | 66/232 |
| 5,014,524 | 5/1991 | Smilovici | 66/64 |
| 5,588,311 | 12/1996 | Kiribuchi | 66/60 R |
| 5,862,682 | 1/1999 | Maenaka et al. | 66/232 |

*Primary Examiner*—Danny Worrell
*Attorney, Agent, or Firm*—Michael J. Striker

[57] ABSTRACT

A knitted article is produced on a flat knitting machine with a carriage and at least one cam system, wherein the carriage speed is controlled within a knitting row in dependence on pattern types produced by individual needles or needle groups, as well as on the properties of knitting thread or threads continuously so that the carriage at each location of the knitting row is moved with a maximum possible speed at which it is guaranteed that no knitting thread is torn.

5 Claims, 3 Drawing Sheets

METHOD FOR PRODUCING A KNITTED ARTICLE ON A FLAT KNITTING MACHINE

BACKGROUND OF THE INVENTION

The present invention relates to a method for producing a knitted article on a flat knitting machine with a carriage with at least one cam system which controls the movements of the needles in correspondence with a pattern program for the knitted article to be produced.

In modern high efficiency flat knitting machines the cam systems which control the needle movements are designed so that the control of the needle no longer limits the maximum possible carriage speed. The carriage speed is limited by the processed knitting threads which can tear off when the forces applied to the needles are too high. Also, the acceleration backing performed by a knitting thread when the associated thread guide is moved through the moving carriage with high speed can lead to a tearing off of the knitting thread. This acceleration backing acts first of all on the knitted article edges, and with certain knitting patterns for example intarsia can occur also inside a knitting row. The knitted articles mainly produced on a flat knitting machine are patterned so that in each knitting row individual needle groups form different structures. For example, in one row stitches and/or tuck loops are formed, stitches and tuck loops in one section are accumulated, floats are inserted, stitches on the same needle bed are laterally displaced or transferred from one needle bed to the opposite needle bed. Depending on what function is performed by the needles, the knitting needles also experience different forces at different locations within a knitting row. For providing a fault-free production on the flat knitting machine, the carriage is moved with such a speed which is permissible so that the knitting thread at the critical location of the knitting row or in other words at the location at which the needles apply the greatest force to the knitting threads, do not tear off. When only a few critical locations inside a knitting row are available, great regions of the knitting product are produced with a carriage speed which is unnecessary low for these regions.

SUMMARY OF THE INVENTION

Accordingly, it is an object of present invention to provide a method of producing a knitted article on a flat knitting machine, which avoids the disadvantages of the prior art.

More particularly, it is an object of the present invention to provide a method of producing a knitted article on a flat knitting machine which is more rational than was before.

In keeping with these objects and with others which will become apparent hereinafter, one feature of present invention resides, briefly stated, in a method of producing a knitted article on a flat knitting machine, in accordance with which the carriage speed is controlled within a knitting row in dependence on the pattern types produced by the individual needles or needle groups as well as on the properties of the utilized knitting threads constantly, so that the carriage at each location of the knitting row is moved with a maximum possible speed, and it is guaranteed that no knitting threads are torn off.

The maximum possible speed of the carriage in the predetermined section of a knitting row is dependent on the material type of the knitting thread and dependent on how the knitting thread is treated by the knitting needles, or in other words whether they form normal, large or small stitches or tuck loops, tuck loops are accumulated, stitches transferred or taken over.

In the control of the carriage speed the information is provided over the type of the knitting thread as well as pattern data , from which it is derived which knitting needles form which structures from the knitting threads. From the data about the used knitting thread or threads, a thread-specific maximum speed is determined. From this, a maximum possible acceleration backing for the threads is calculated. From the pattern data is determined at which locations within the knitting row the thread-specific maximum speed must be reduced. If within the knitted article sections are available in which no needle movements are required, the carriage in these sections can be moved with speeds which can reach possible maximum speed in accordance with its drive device, since in these sections no forces are applied to the knitting threads. Thereby a further increase of the production speed of the knitted article is possible.

Moreover, the carriage speed at the locations of a knitting row can be reduced, at which the carriage must perform a mechanical switching to an auxiliary aggregate. Such an auxiliary aggregate can be for example a narrower device whose movement course is controlled by cam parts on the carriage. The region of the reduced speed as well as the amount of the speed reduction is determined by the pattern data.

Contrary to the known methods, the production of a knitted article on a flat knitting machine in accordance with the present invention guarantees a very rational manufacture, since the carriage speed always assumes a permitted maximum value for a fault-free production of the knitted article. The knitting row is no longer formed with such a carriage speed which is determined by the critical case in the knitting row.

The method in accordance with the present invention is realized with a flat knitting machine having a carriage with at least one cam system which controls the movements of the needles in correspondence with a pattern program for the knitted article to be produced, and with a control device which controls the drive unit of the carriage in correspondence with the parameters of the knitted thread or threads as well as the pattern types produced by individual needles or needle groups during the formation of a knitting row. The control device can be connected for this purpose preferably with a pattern program storage of the machine.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
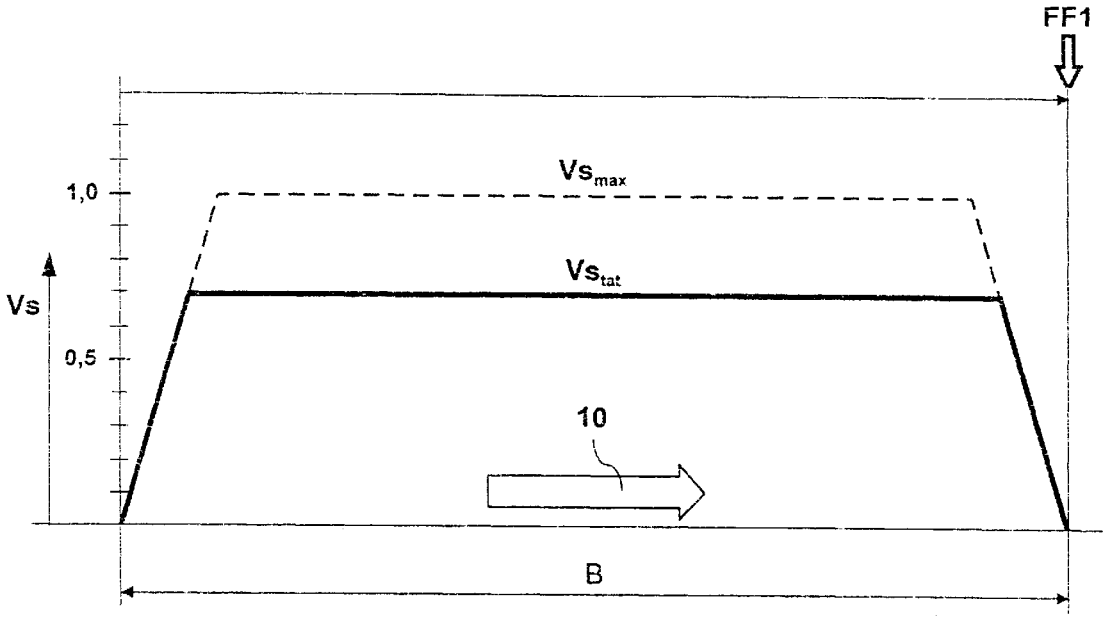
FIG. 1 is a view showing a carriage speed course over a knitting row in accordance with the prior art.

FIG. 1 shows the course of a carriage speed Vs over a knitting row of a knitted article with a width B in accordance with a production method of the prior art. The knitting row is formed in the whole width B of the knitted article with the same knitting threads. Symbol $Vs_{max}$ is used to identify the maximum speed of the carriage which is dependent from the corresponding material of the knitting thread, when all needles form stitches in normal size. In the shown embodiment, the solid lines identify actual maximum speed $Vs_{tat}$, however lower than the maximum speed $Vs_{max}$ since the knitted article has at least at one location a section, within which the needles apply such a high forces to the knitting threads that a thread reduction is needed to prevent tearing off of the knitting threads. As clearly shown in the diagram of FIG. 1, during the process in accordance with the prior art, the total knitting row is knitted with a constant speed of the carriage, with the exception of the starting and finishing regions in which the carriage is accelerated after the reverse of the knitting direction 10 and before the new reverse of the knitting direction 10 must be braked.

Figure 2:
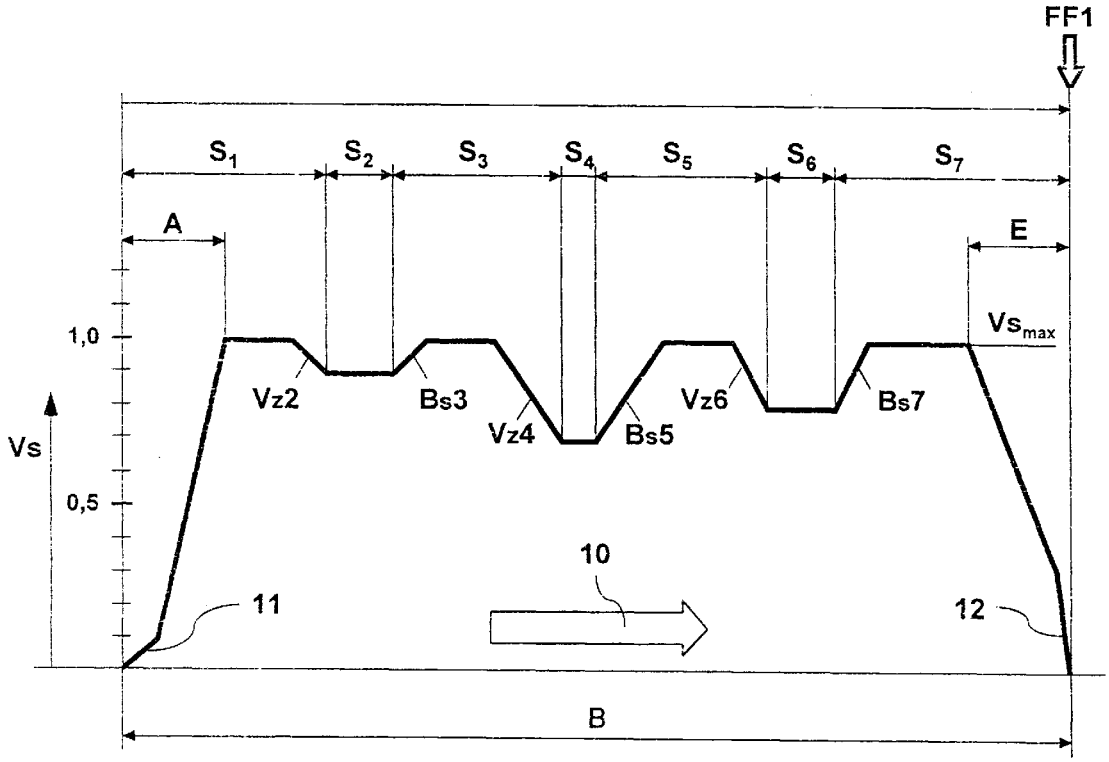
FIG. 2 is a view showing a first carriage speed course over a knitting row of a knitted article in accordance with the present invention.

FIG. 2 shows a first course of the speed Vs of a carriage in a production method in accordance with the present invention. Here also the total knitting row with the width B is formed by a knitting thread supplied with a thread guide FF1. The knitting direction is identified with an arrow 10. In a starting region A of the knitting row, the carriage is accelerated from a knitted article edge. The acceleration in a portion 11 of the curve of the speed Vs is smaller than later, whereby the acceleration backing of the acceleration thread is prevented. The knitting row has a first section $S_1$, in which all needles form normal size stitches, so that here the carriage can be moved with its maximum possible speed $Vs_{max}$. In the subsequent portion $S_2$ of the knitting row increased stitches are formed, whereby the carriage speed must be lowered. The deceleration phase required for the speed reduction is identified with $Vz_2$. In the following portion, $S_3$ of the knitting row all needles again need normal size stitches, or in other words the speed can be accelerated in the region $Bs_3$ again to the maximum speed $Vs_{max}$. In the subsequent section $S_4$ the knitting thread is floated over several needles. For this purpose the thread must be inserted with a small own tension, which is possible only when the carriage speed is reduced. Finally, the course of the carriage speed Vs at the transition between the section $S_3$ and the section $S_4$ has the deceleration portion $Vz_4$. In the subsequent section $S_5$ all needles need normal size stitches, so that the carriage again can be accelerated to the maximum speed $Vs_{max}$.

In the section $S_4$ stitches are transferred from one needle bed to another needle bed. For this purpose again a lowering of the carriage speed Vs is needed before the carriage in the last section $S_7$ in which all needles again need normal side stitches, is accelerated again to the maximum speed $Vs_{max}$. In the portion E at the end of the knitting row the carriage is decelerated before the reverse of the carriage direction 10 to a full stop, and the deceleration is achieved shortly before reaching the stop in a region 12 again, so that the knitting threads which run from the edge stitch the thread guide FF1 has a smallest possible tension and thereby the edge stitch does not narrow. In the example shown in FIG. 2 the maximum speed $Vs_{max}$ is reached in the stitching region between the starting acceleration A and finishing deceleration E at 41% of the carriage path. When compared with FIG. 1, the course of the carriage speed shows a substantial reduction of the production time for the knitting row.

Figure 3:
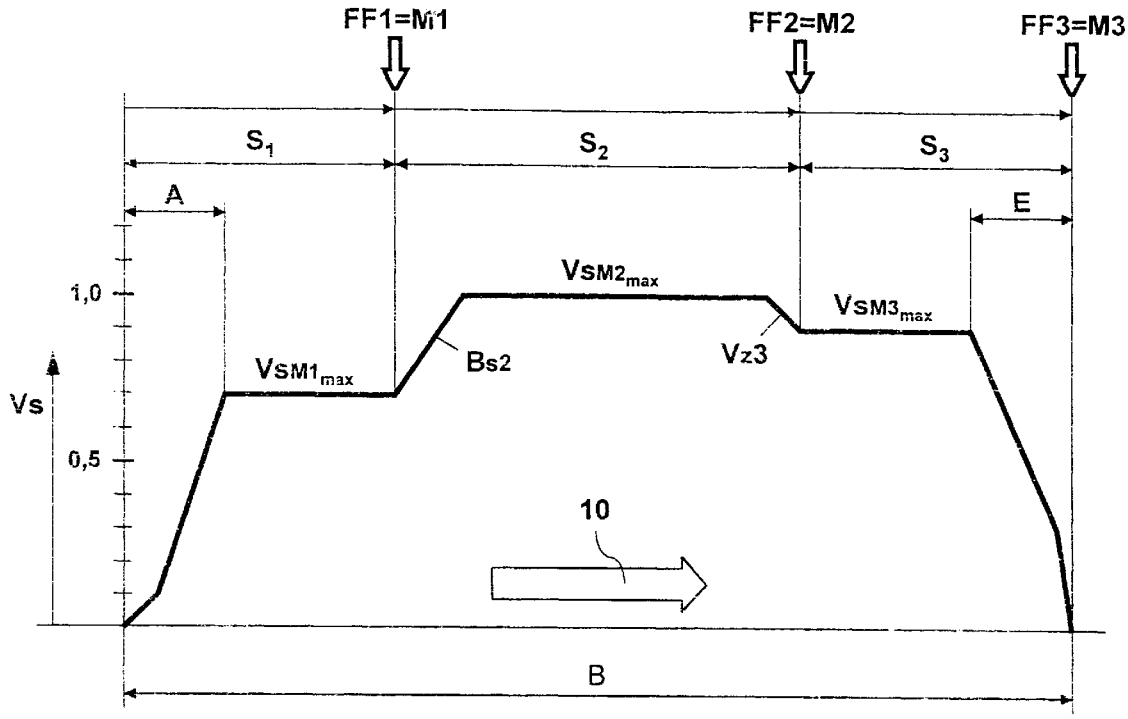
FIG. 3 is a view showing a second carriage speed course over a knitting row of a knitted article.

FIG. 3 shows a further example of a speed course Vs of a carriage over a knitting row of the width B. This knitting row is formed by three different knitting threads of different materials M1, M2 and M3. The first knitting thread knits the material $M_1$ in the first section $S_1$, the second knitting thread knits the material M2 in the second section $S_2$ and the third knitting thread knits from the material M3 in the third section $S_3$. Because of the different materials M1, M2, M3 of the knitting threads, three different maximum speeds $V_s$ $M1_{max}$, $VsM2_{max}$, $VsM3_{max}$ of the carriage are available, with which the carriage can move before the corresponding thread is torn off, when the needles form stitches of normal size. The starting and finishing portions A, E, are identical to those shown in FIG. 2. In the section $S_1$, stitches of normal size are formed by the first thread and thereby the carriage is accelerated to the associated permitted maximum speed $VsM1_{max}$. In the section S2 the more robust second knitting thread knits with the material M2, so that the carriage can be accelerated to the higher maximum speed $VsM2_{max}$ (Bs2). In section $S_3$ the third knitting thread knits with the material M3 whereby also exclusively stitches of normal size are produced so that the carriage now is adjusted to the permissible maximum speed for the third thread $VsM3_{max}$, The material M1 of the first knitting thread can for example be a mohar threads, the material M2 can be an acrylic mixture, and the material M3 can be for example fleece wool.

Figure 4:
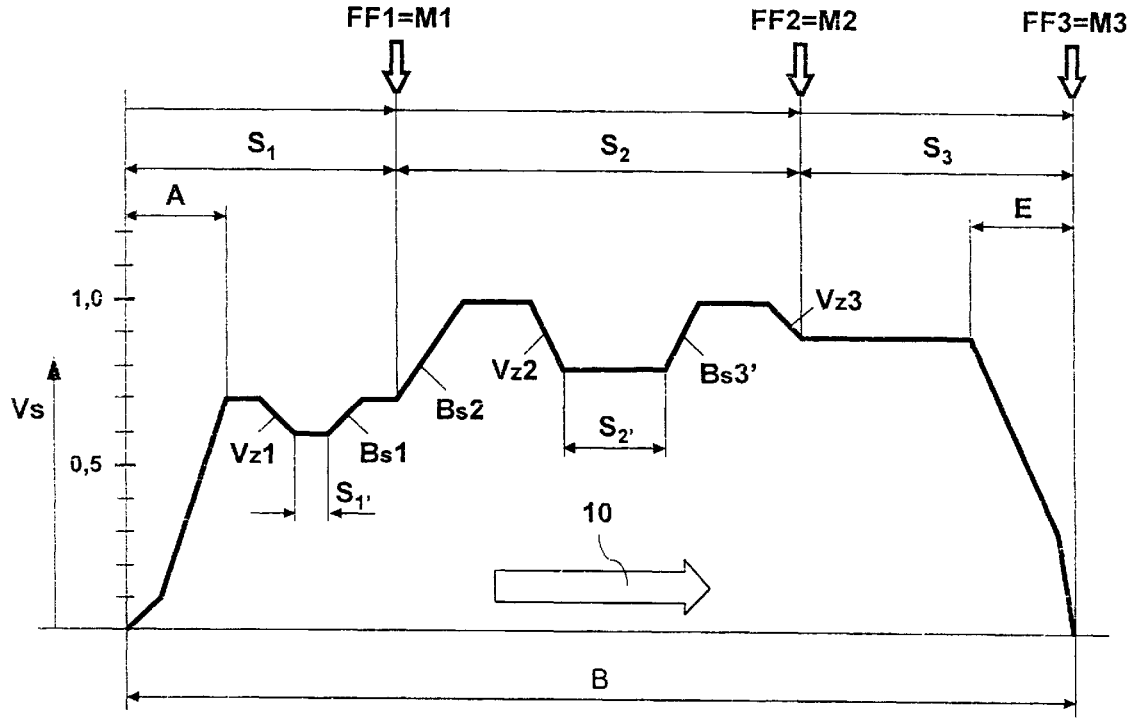
FIG. 4 is a view showing a third carriage speed course over a knitting row of a knitted article.

FIG. 4 shows a speed course Vs of a carriage over a knitting row which is formed of three sections $S_1$, $S_2$, and $S_3$ with the same thread from different materials M1, M2, and M3 as the knitting row in FIG. 3. In the sections $S_1$ and $S_2$ however needle regions $S_1$ and $S_2$ are available in which due to the corresponding knitting threads either a greater stitches are formed or stitches are transferred to the opposite needle bed. In both regions $S_1$ and $S_2$ a reduction of the carriage speed is required, as clearly shown in FIG. 4. In the section $S_3$ again normal size stitches are formed by all needles. Here the carriage can maintain its maximum speed until the final portion E.

Figure 5:
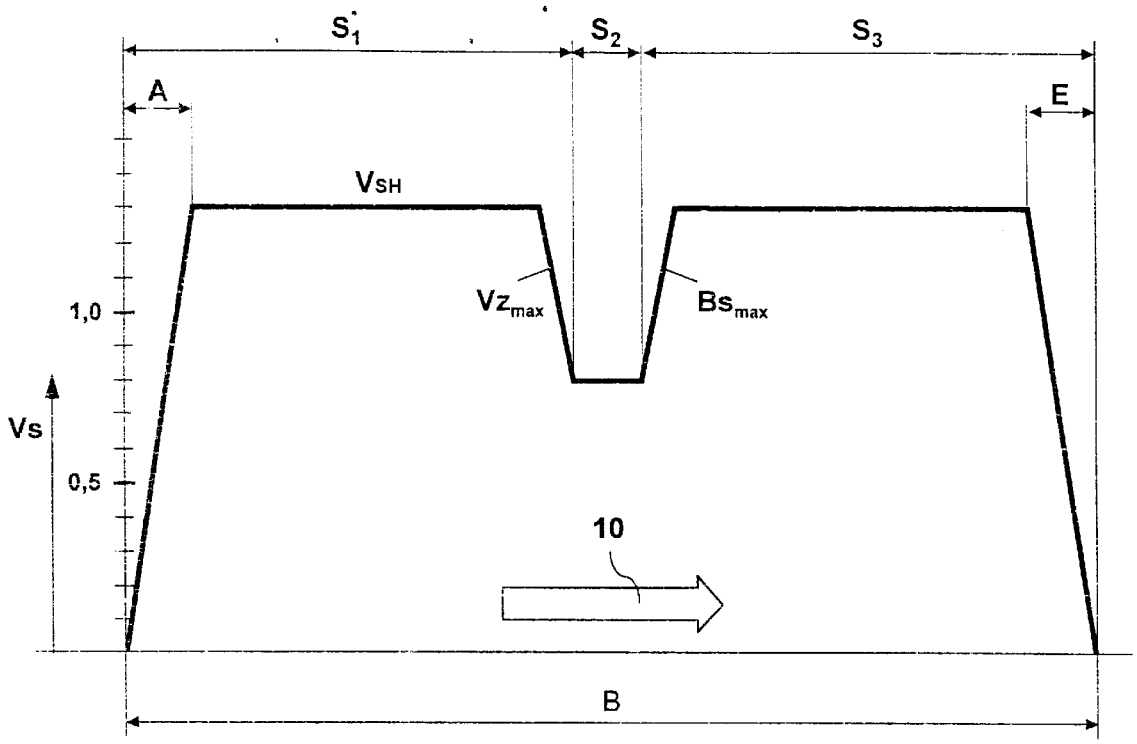
FIG. 5 is a view showing a fourth carriage speed course over a knitting row of a knitted article.

FIG. 5 shows the example of a speed course Vs of a carriage during movement over a knitted article of the width B, wherein no stitches are formed. However in the central region of the knitted article a section $S_2$ is available, in which the stitches are transferred to the opposite needle bed. In both remaining regions $S_1$ and $S_3$ no needle movements are however performed. The carriage in the starting region A which is very short, can be accelerated to a maximum possible speed VsH by its drive device. This speed is maintained to shortly before reaching the section $S_2$, where it is braked in a region $Vz_{max}$, so that the stitch transfer can be performed in the region $S_2$ with no danger. Subsequently, the carriage is again accelerated in the region $Bs_{max}$ to the maximum permissible speed VsH and braked again in the finishing region E to a stop before the carriage direction 10 is reversed. If for some reasons it is desirable to move the carriage in the regions $S_1$ and $S_3$ not with the maximum speed, naturally all possible speeds below VsH can be selected.

Figure 6:
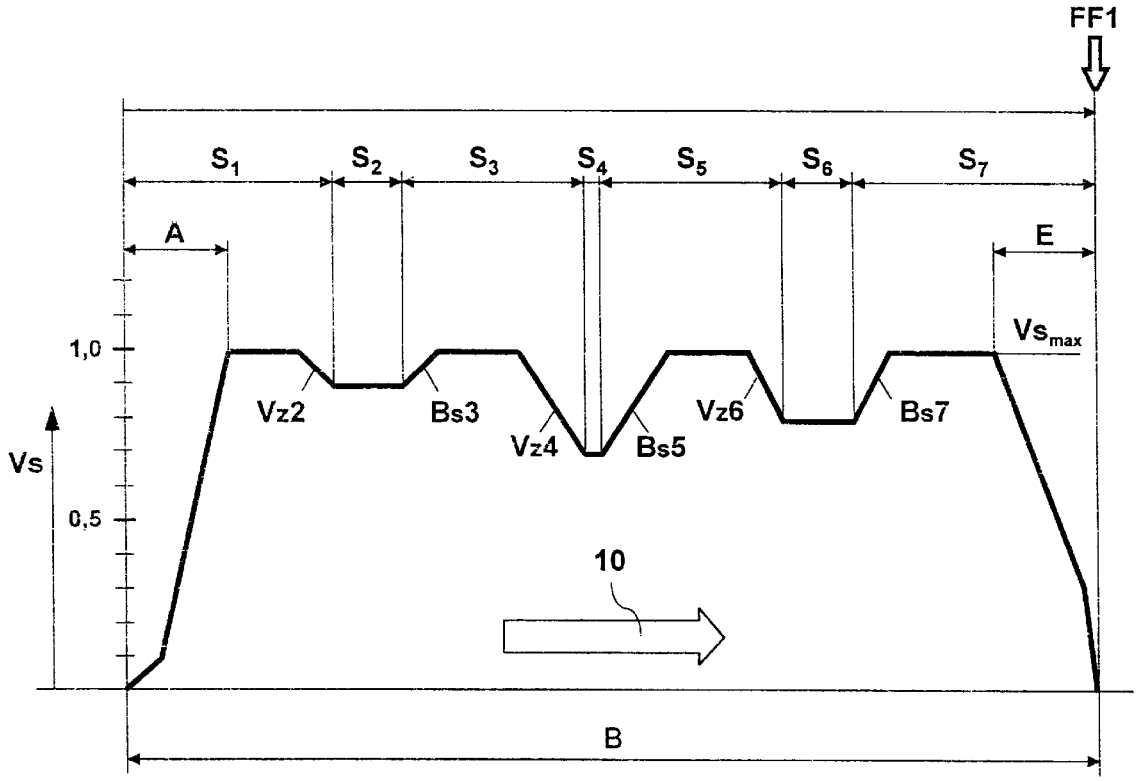
FIG. 6 is a view showing a fifth carriage speed course over a knitting row of a knitted article.

FIG. 6 shows a course of a carriage speed Vs over a knitted article width B wherein the illustrated knitting row is formed continuously with a single knitting thread. The knitting row has several different sections $S_1$ to $S_7$. In the sections $S_1$, $S_3$, $S_5$, $S_7$ stitches have a normal size, so that in this region the carriage can be brought to a maximum speed permissible by the thread material. In the section $S_2$ increased stitches are formed which load the stitching thread stronger, so that the carriage in this region must have a lowered speed. In the section $S_4$ the carriage performs a mechanical switching function. For this purpose the switching speed must be reduced in correspondence with the kinematic structure of the connected apparatus. The apparatus can be for example a narrower device, whose movement is controlled by cam parts on the carriage. A stitch transfer from one needle bed to another needle bed takes place in the portion $S_6$, so that here again a reduction of the carriage speed relative to the maximum speed in the sections S5 and S7 must take place. The regions Vz2 Vz4 and Vz6 each have regions in which the carriage is braked, while the regions Bs3, Bs5 and Bs7 are regions in which the carriage is accelerated to its maximum speed permissible by the thread material.

It will be understood that each of the elements described above, or two or more together, may also find a useful application in other types of methods differing from the types described above.

While the invention has been illustrated and described as embodied in a method for producing a knitted article on a flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A method of producing a knitted product on a flat knitting machine with a carriage with at least one cam system, comprising the steps of regulating movements of needles in correspondence with a pattern program for the knitted article to be produced; and means for controlling a carriage speed within a knitting row in dependence on pattern types produced by individual needles or needle groups, and on properties of a knitting thread or knitting threads continuously, to vary the carriage speed within the knitting row so that the carriage at each location of the knitting row is moved with a maximum possible speed which does not cause tearing off of knitting threads.

2. A method as defined in claim 1, wherein said controlling includes moving the carriage in sections within the knitted article in which no needle movements are needed with speeds which can reach a maximum speed possible in correspondence with its drive device.

3. A method as defined in claim 1, wherein said controlling includes reducing a speed of the carriage at locations of a knitting row, at which the carriage performs a mechanical connection to an auxiliary aggregate.

4. A flat knitting machine for producing a knitted article, comprising a carriage with at least one cam system; means for controlling movements of needles in correspondence with a pattern program for admitted article to be produced; and a control device which controls a drive unit of said carriage in correspondence with parameters of a knitting thread or knitting threads, and also in correspondence with pattern types produced by individual needles or needle groups during a formation of a knitting row.

5. A flat knitting machine as defined in claim 1; and further comprising a pattern program storage of the machine, said control device being connected with said pattern program storage of the machine.

* * * * *